US008251646B2

(12) United States Patent
Jahns

(10) Patent No.: US 8,251,646 B2
(45) Date of Patent: Aug. 28, 2012

(54) ROTATING UNIT FOR AN AXIAL-FLOW COMPRESSOR

(75) Inventor: Ingo Jahns, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 497 days.

(21) Appl. No.: 12/453,131

(22) Filed: Apr. 29, 2009

(65) Prior Publication Data

US 2009/0274547 A1 Nov. 5, 2009

(30) Foreign Application Priority Data

Apr. 30, 2008 (DE) ..... 10 2008 021 683

(51) Int. Cl.
*F01D 17/12* (2006.01)

(52) U.S. Cl. ..... 415/160; 415/150; 415/170.1; 415/209.3; 415/60

(58) Field of Classification Search ..... 415/148–167, 415/174.2, 209.3, 209.4, 170.1, 60
See application file for complete search history.

(56) References Cited

U.S. PATENT DOCUMENTS

| | | | | |
|---|---|---|---|---|
| 2,671,634 | A * | 3/1954 | Morley | 415/160 |
| 2,950,084 | A * | 8/1960 | Perry | 415/160 |
| 4,086,042 | A * | 4/1978 | Young | 418/139 |
| 4,239,450 | A * | 12/1980 | Geitner et al. | 415/160 |
| 4,278,398 | A * | 7/1981 | Hull | 415/160 |
| 4,950,129 | A * | 8/1990 | Patel et al. | 415/160 |
| 5,380,152 | A * | 1/1995 | Sikorski et al. | 415/160 |
| 5,636,968 | A * | 6/1997 | Audet et al. | 415/160 |
| 5,796,199 | A * | 8/1998 | Charbonnel | 310/90 |
| 6,676,378 | B2 * | 1/2004 | Corbin et al. | 416/160 |
| 6,802,692 | B2 * | 10/2004 | Bouru | 415/160 |
| 8,147,187 | B2 * | 4/2012 | Foucher | 415/155 |
| 2007/0020092 | A1 * | 1/2007 | Giaimo et al. | 415/160 |

FOREIGN PATENT DOCUMENTS

| | | |
|---|---|---|
| DE | 60319612 | 4/2009 |
| EP | 1867877 | 12/2007 |
| JP | 9280199 | 10/1997 |

OTHER PUBLICATIONS

German Search Report dated Jun. 28, 2011 from counterpart foreign application.

* cited by examiner

*Primary Examiner* — Fernando L Toledo
*Assistant Examiner* — Victoria K Hall
(74) *Attorney, Agent, or Firm* — Timothy J. Kilma; Shuttleworth & Ingersoll, PLC

(57) ABSTRACT

An axial-flow compressor has at least one stator vane row. At least one blade of the stator vane row is provided as a rotating unit (6), with the rotating unit being completely rotatable about a drive axis to act as a rotary compressor and with the drive axis being essentially vertical to a rotary axis of the axial-flow compressor.

12 Claims, 8 Drawing Sheets

FIG. 7
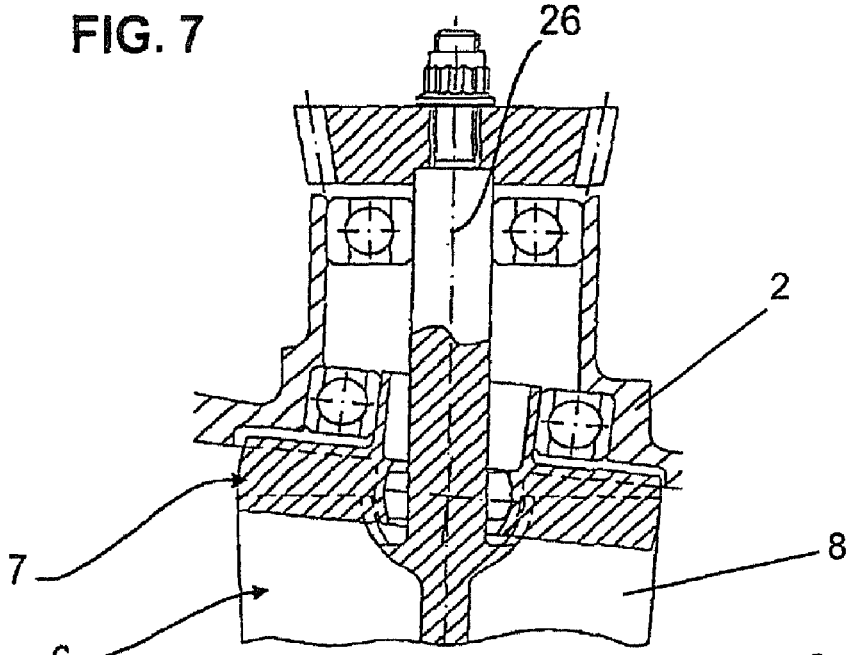
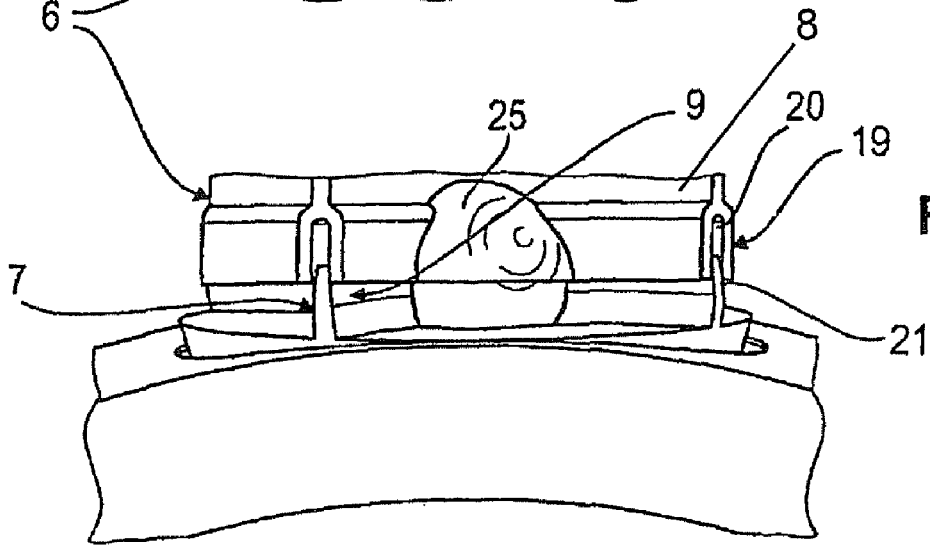
FIG. 8

ROTATING UNIT FOR AN AXIAL-FLOW COMPRESSOR

This application claims priority to German Patent Application DE102008021683.6 filed Apr. 30, 2008, the entirety of which is incorporated by reference herein.

The present invention relates to an axial-flow compressor, with the conventional stator vanes being replaced by rotating units.

Figure 1:
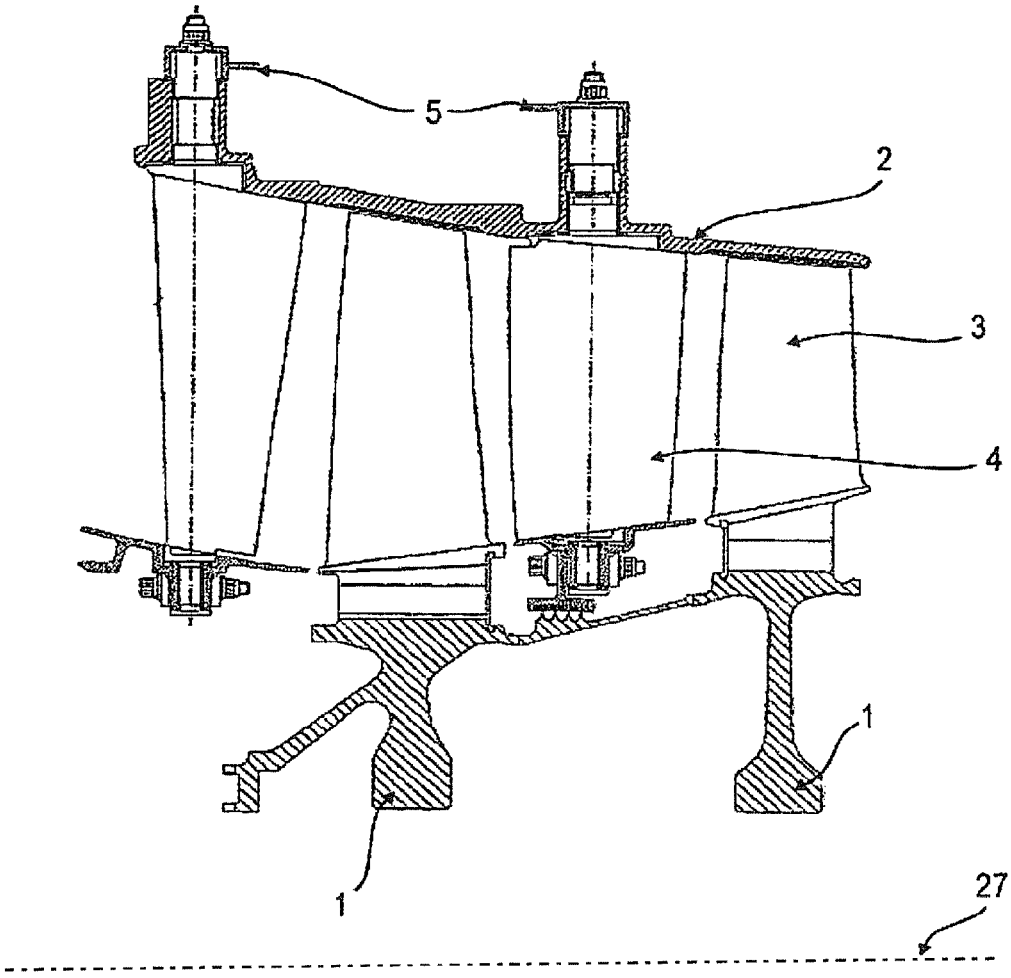
Fig. 1 Prior Art

FIG. 1 shows a meridional section of an axial-flow compressor in accordance with the state of the art.

Present-day axial-flow compressors include a rotor 1 with mostly several rows of rotor blades 3 and a casing 2 in which stator vanes 4 are fitted. A row of stator vanes is arranged upstream of each row of rotor blades. The stator vanes 4 build up pressure by converting the kinetic energy of the fluid. Furthermore, they redirect the fluid to the subsequent rotor blade row. In most cases, only the forward stator vane rows are connected to an actuating mechanism 5, enabling the setting of the stator vanes to be varied in dependence of the speed of the axial-flow compressor.

It is known from the state of the art that the forward stator vanes 4 are settable by a drive train to redirect the air or fluid into an angle suitable for entry to the subsequent rotor blades.

From literature (for example GB 978,658) a design with rotating casing is known. Here, the casing with the stator vanes contained therein and the actual rotor rotates in different directions. However, this type of casing has to be considerably heavier than a usual casing to carry the centrifugal loading.

A broad aspect of the present invention is to provide an axial-flow compressor, which is capable of building up maximum pressure, while being simply designed and featuring short length and low weight.

According to the present invention, an axial-flow compressor with at least one stator vane row is therefore provided in which at least one vane of the stator vane row is provided as rotating unit and in which the rotating unit is completely rotatable about a drive axis. The drive axis is here essentially vertical to a rotary axis of the axial-flow compressor.

The present invention replaces the variable stator vanes according to the state of the art by rotating units, which are also referred to as new-type rotating stator units, which both redirect and further compress the air or fluid, respectively. Due to the contraction of the gas-wetted surfaces or the circumference of the inner space of the axial-flow compressor caused by the compression process through the rotor blades, the use of conventional gear-type or vane-type pumps is to be ruled out. Furthermore, the compressor is annular.

In order to avoid excessive circumferential spacing of the individual rotating units, it is advantageous to provide these in conical form. Advantageously, the inclination of the gas-wetted surfaces is ensured by an additional tilting rotor. The blades of the rotating unit and the blades of the tilting rotor are provided such that they are in engagement with each other.

It is further advantageous to connect the rotating unit via a drive shaft to a driving device. With the rotating unit and the tilting rotor being in engagement with each other, the tilting rotor will be driven in association when the rotating unit is driven by the driving device. Both the rotating unit and the tilting rotor are borne in the casing.

The tilting rotor is arranged such in the casing that a platform of the tilting rotor follows the contraction of the gas-wetted surface. The forced rotation of the tilting rotor and the inclined suspension relative to the rotating unit effect a relative movement between the rotating unit and the tilting rotor.

The axis of the tilting rotor and the axis of the rotating unit intersect at one point. Advantageously, the blades of the tilting rotor are spherically shaped towards this point. The blades of the rotating unit extend tangentially into these spherically shaped blades of the tilting rotor.

The principle described above is applicable to both the casing and the inner shroud.

It is further advantageous to curvilinearly shape the blades of the tilting rotor to minimize the gap between rotating unit and tilting rotor.

It is further advantageous to provide ribs between the rotating units. The ribs extend between the casing to the inner shroud and provide the sideward confinement for the rotating units for compression of the fluid or air, respectively. Simultaneously, the clearance between the ribs serves as an inlet and an outlet opening for the fluid. Oil supply and discharge from the inner shroud, if applicable, is implementable via the ribs.

It is further advantageous to taper the rotating units or their blades, respectively. The taper provides for additional compression by centrifugal forces.

In a further advantageous development, the axis of the rotating unit is also tapered. Thus, the volume between the blades of the rotating unit and the ribs is constrained.

In a further advantageous development, the blades of the rotating unit are spirally arranged on the circumference of the rotating unit. Thus, air or fluid, respectively, is delivered from the radially inner areas to the radially outer areas and compressed.

Accordingly, the application of the axial-flow compressor according to the present invention provides for increased pressure build-up already in the forward stage of the compressor. This enables the same amount of pressure to be built up with fewer compressor stages. Consequently, the compressor can be shorter and lighter.

Figure 5:
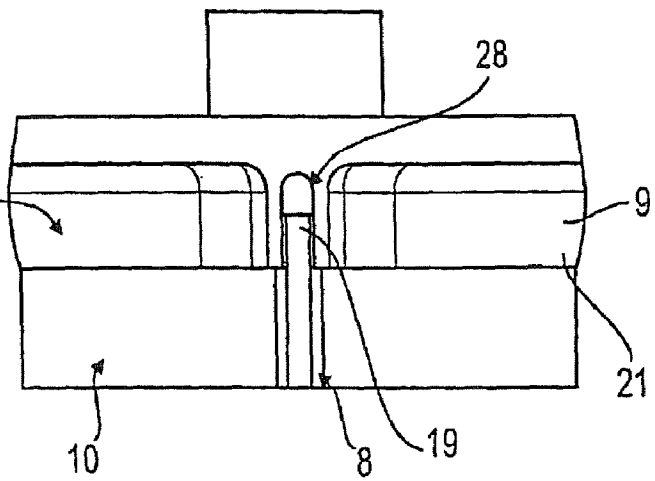
Figure 6:
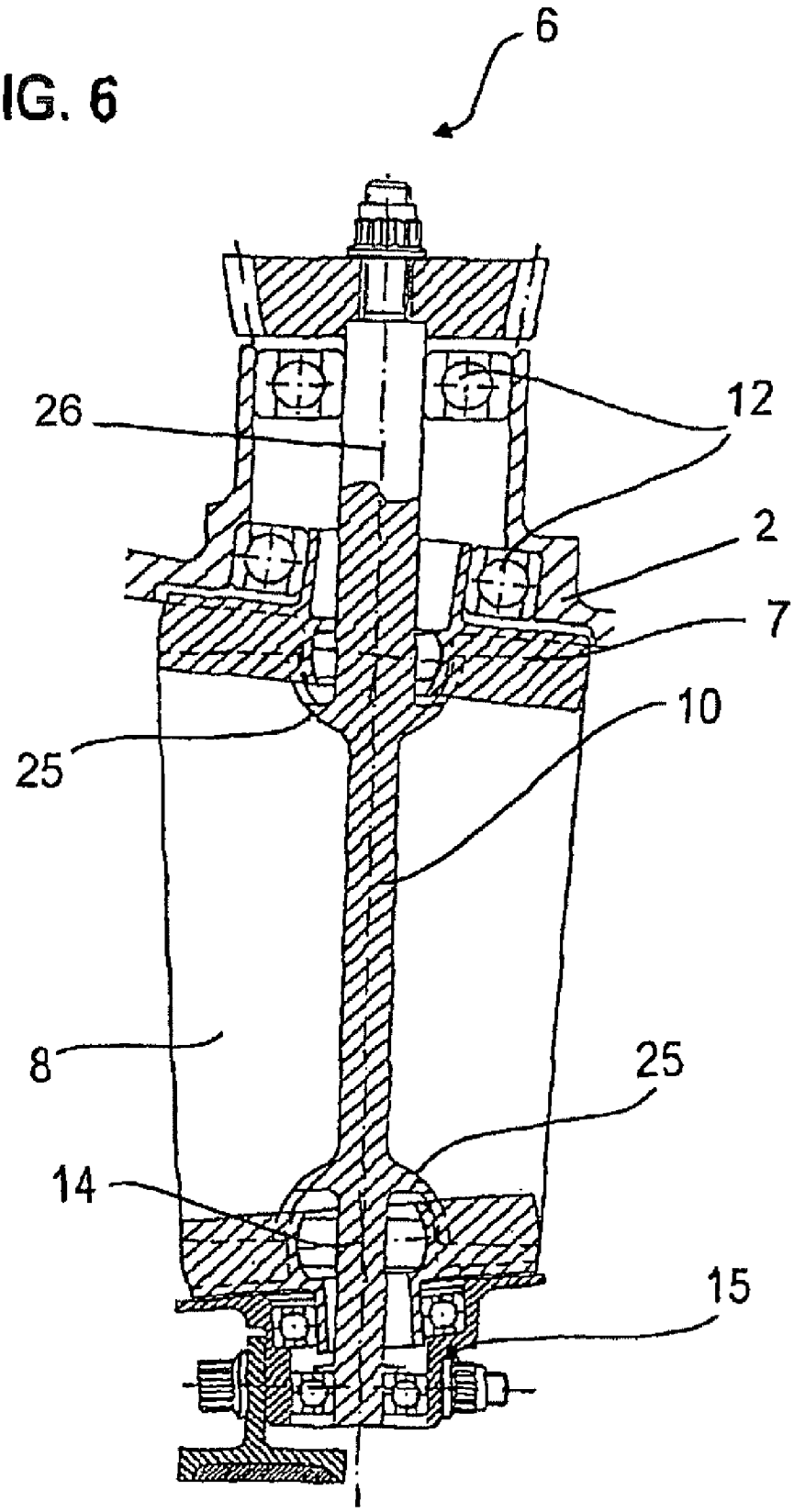
Figure 9:
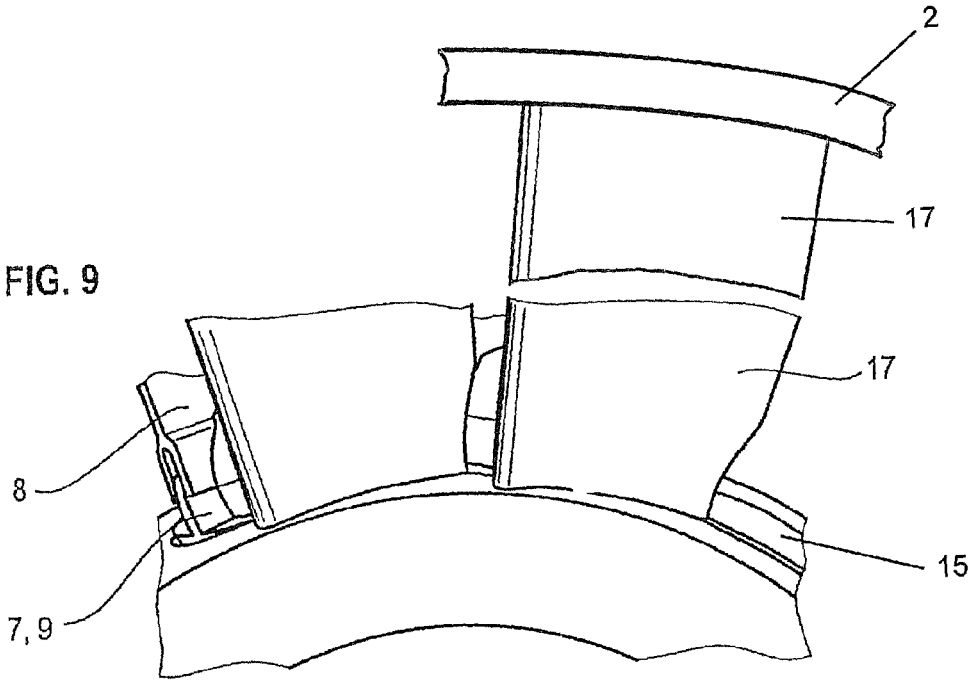
Figure 10:
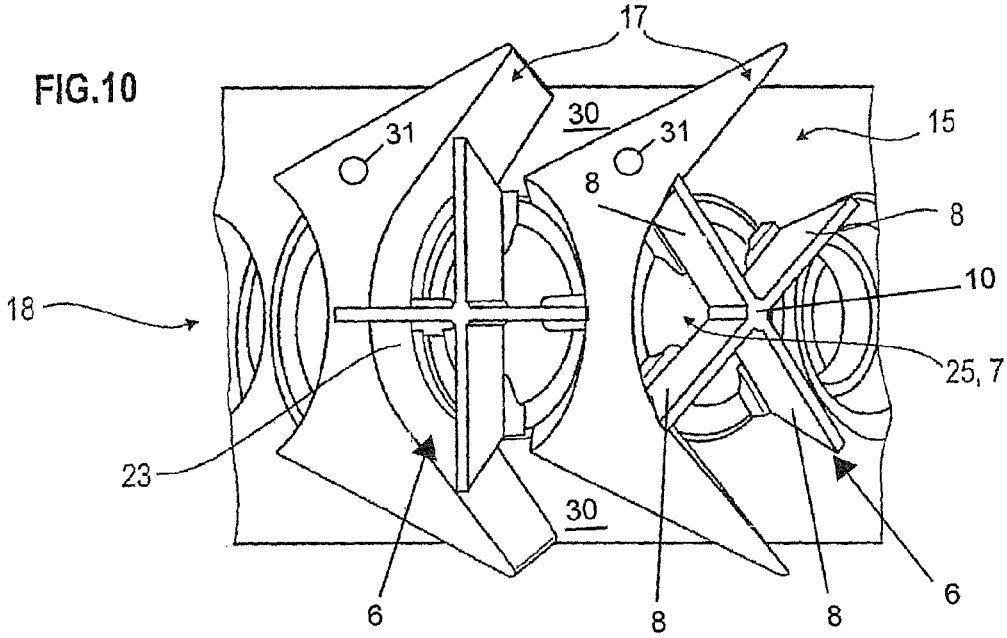
Figure 11:
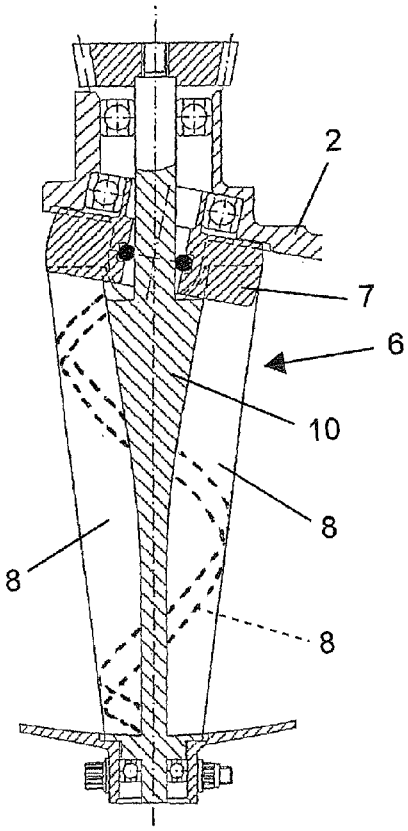
Figure 12:
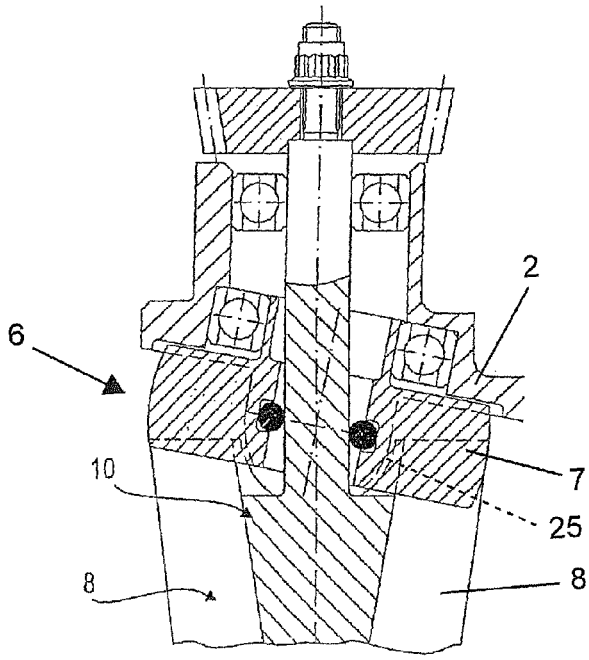

The present invention is more fully described in light of the accompanying drawings showing three embodiments. In the drawings, FIG. 1 shows the state of the art as mentioned above, FIG. 2 shows a meridional section of an axial-flow compressor in accordance with the present invention, with the ribs between two rotating units not being shown for better clarity, FIG. 3 shows a rotating unit in accordance with a first embodiment, with the ribs between two rotating units not being shown for better clarity, FIG. 4 is a detail view of the rotating unit from FIG. 3, with the ribs between two rotating units not being shown for better clarity, FIG. 5 shows a tilting rotor in a detail view from FIG. 3, with the ribs between two rotating units not being shown for better clarity, FIG. 6 shows a rotating unit in accordance with the present invention as per a second embodiment, FIG. 7 is a detail view of the rotating unit from FIG. 6, with the ribs between two rotating units not being shown for better clarity, FIG. 8 shows a tilting rotor in a detail view from FIG. 6, with the ribs between two rotating units not being shown for better clarity, FIG. 9 is a three-dimensional view of the tilting rotor from FIG. 6, FIG. 10 is a three-dimensional view of an inner shroud of an axial-flow compressor provided with ribs, FIG. 11 shows a rotating unit in accordance with the present invention as per a third embodiment, with the ribs between two rotating units not being shown for better clarity, and FIG. 12 is a detail view of the rotating unit from FIG. 11, with the ribs between two rotating units not being shown for better clarity.

Figure 2:
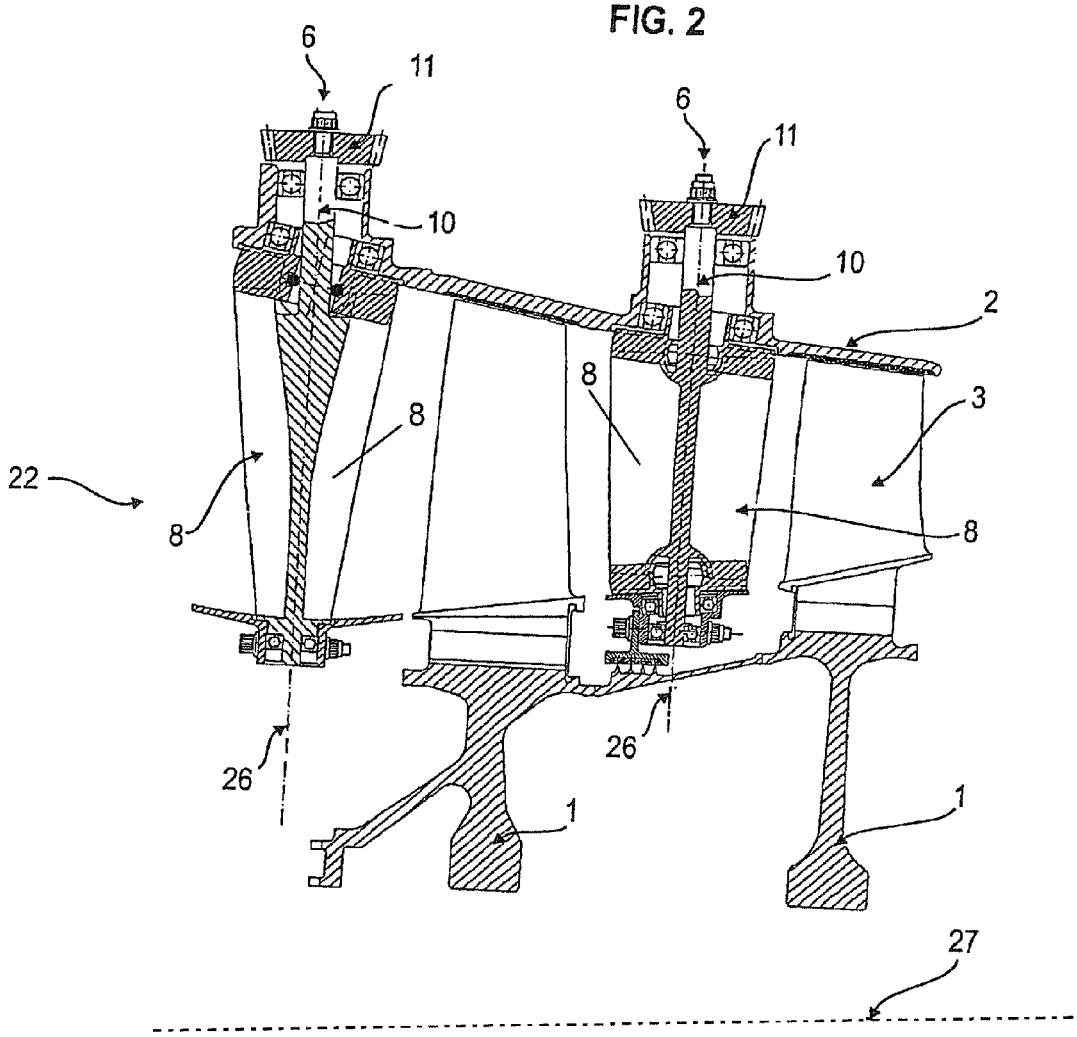

FIG. 2 shows an axial-flow compressor in meridional section with an axial-flow compressor rotary axis 27, a rotor 1 and an inner space 22. The rotor 1 includes rotor blades 3. The axial-flow compressor is confined on the outside by a casing 2. Further shown are a left-hand rotating unit 6 and a right-hand rotating unit 6. The rotating units can also be referred to as new-type rotating stator units. Each of these rotating units 6 includes a blade 8, a drive shaft 10 and a driving device 11 which is here provided as a gearwheel. A drive via individual electric motors is also possible. The drive axis 26 passes through the drive shaft 10. The rotating unit 6 is fully rotatable about its drive axis 26 by the driving device 11 and the drive shaft 10. Furthermore, the rotating unit 6 is located at the top in the casing 2. The seal to the rotor 1 is shown in FIG. 2 for the right-hand rotating unit 6, while being omitted or dispensable for the left-hand rotating unit 6.

Figure 3:
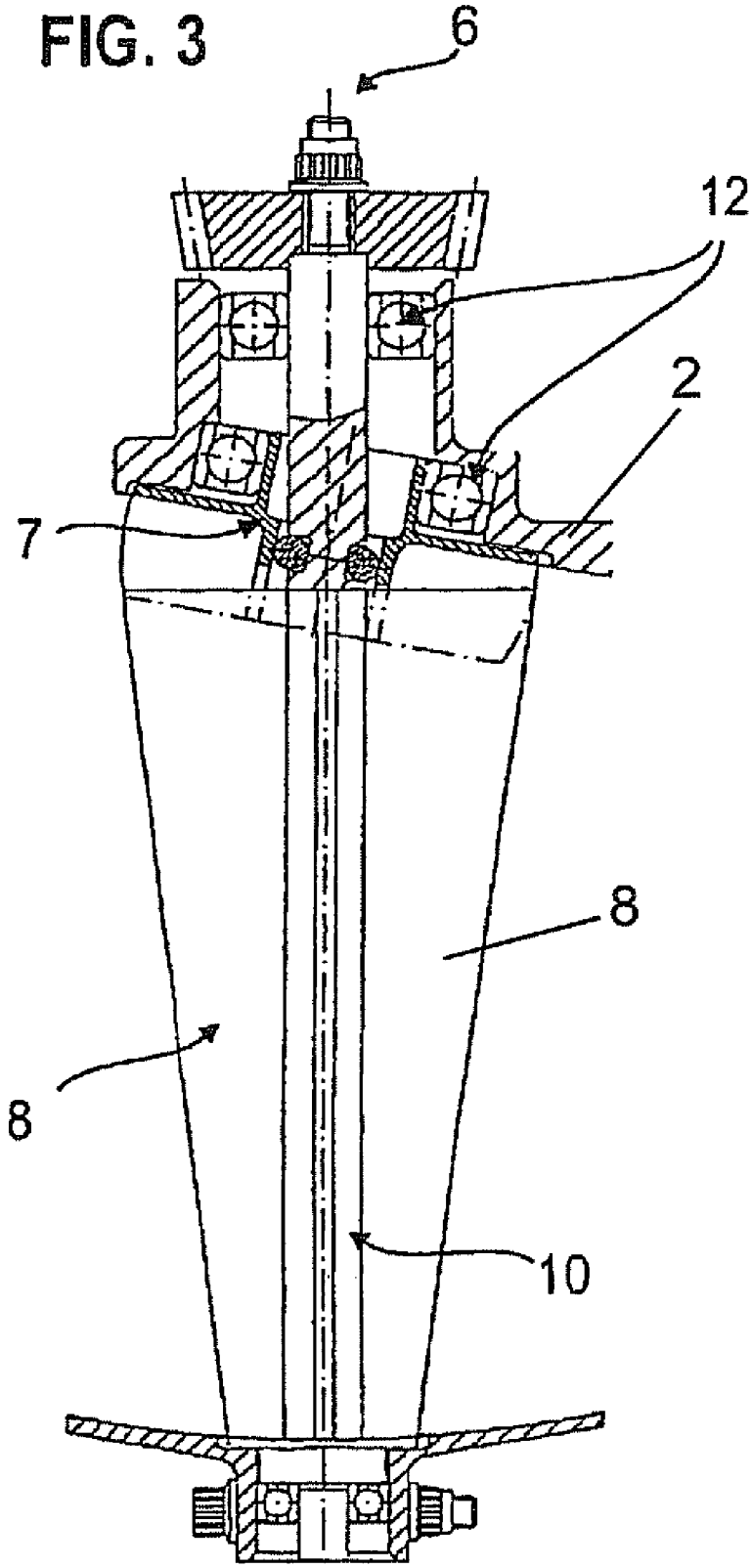

FIG. 3 shows a rotating unit 6 according to a first embodiment with a bearing 12, a tilting rotor 7, blades 8 and the drive shaft 10. Shown here is the location of the drive shaft 10 in the casing 2 by the bearing 12 which is provided as anti-friction bearing. The tilting rotor 7 is likewise located relative to the casing 2 by an anti-friction bearing arrangement 12 and relative to the drive shaft 10 by a further roller bearing 12.

Figure 4:
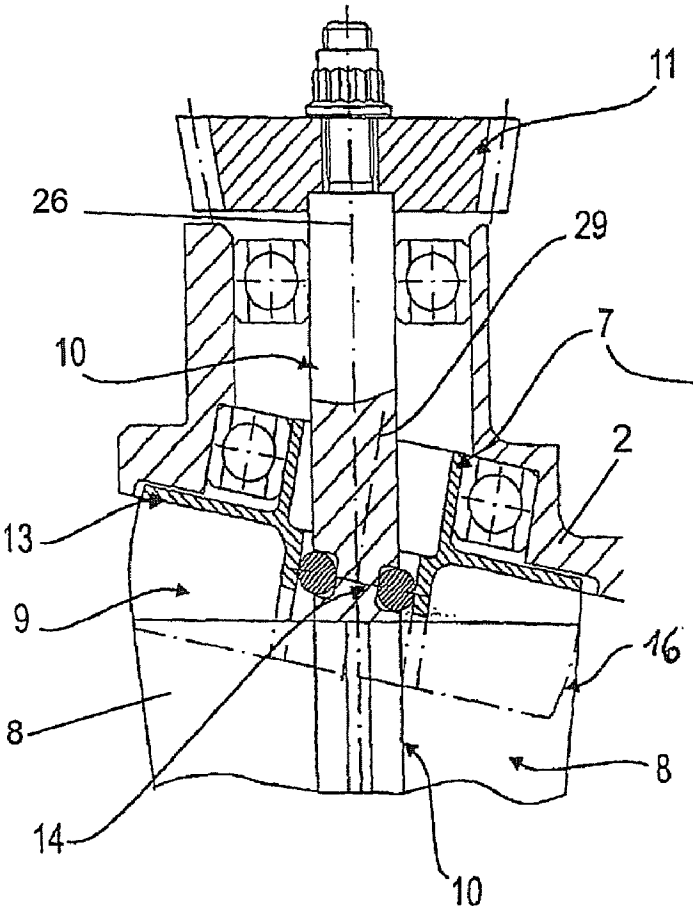

FIG. 4 shows a detail view of the rotating unit according to the first embodiment. Shown here is the tilting rotor 7 with a platform 13 and tilting rotor blades 9. FIG. 4 further shows curvilinear portions 16 of the tilting rotor blades 9. The dashed line 29 indicates the rotary axis of the tilting rotor. This rotary axis 29 of the tilting rotor 7 and the drive axis 26 establish the pivot 14, the relatively pivoting connection between the blade 8 and the tilting rotor 7.

FIG. 5 is a detail view of the tilting rotor 7 according to the first embodiment. The tilting rotor 7 includes pockets 28 for receiving blade ends 19 of the blades 8 in a movable relationship. Accordingly, blade ends 19 and blade ends 21 of the tilting rotor 7 overlap each other.

FIGS. 6-10 show a rotating unit according to a second embodiment. Contrary to the first embodiment, the blades 8 of the rotating unit have pockets 20 at their ends which accommodate the tilting rotor blades 9.

Furthermore, identical or functionally identical parts are designated with the same reference numerals in all embodiments.

FIG. 6 and the appertaining detail view of FIG. 7 show the partially spherical shape of the drive shaft 10 towards the tilting rotor 7.

FIG. 8 is a three-dimensional view of the rotating unit 6 according to the second embodiment in the area of a rotor hub which further clarifies the accommodation of the tilting rotor blade ends 21 of the tilting rotor blades 9 in the pockets 20 of the blades 8.

FIG. 9 is a perspective detail view of the rotating unit according to the second embodiment with a generally axial perspective. The discussion below with respect to FIG. 10 also applies to FIG. 9.

FIG. 10 is a perspective view looking generally radially inwardly. Shown here are two rotating units 6 within a stator vane row 18. Arranged between the rotating units 6 are ribs 17 which extend between and connect the casing 2 to an inner shroud 15. These ribs 17 form a sideward confinement, and thus a closed space 23, on one side of each of the rotating units 6 for the compression of air or fluid, via the action of the blades 8 rotating around the drive axis 26 of the drive shaft 10 and with respect to the rib 17. Simultaneously, the gaps 30 between the ribs 17 serve as inlet and outlet openings for the compression function occurring via the closed spaces 23 between the ribs 17 and the blades 8. Supply and discharge from the inner shroud 15, if applicable, can be implemented via passages 31 extending through the ribs 17. The provision of ribs 17 as a sideward confinement to the rotating units 6 can be found in all embodiments. The inner geometry of the ribs 17, that is, the portions facing the rotating units 6, follows a profile of the rotating units 6.

FIGS. 11 and 12 show a rotating unit 6 according to a third embodiment. Clearly visible here is the tapering of the drive shaft 10. The tapering of the drive shaft 10 provides for further compression by centrifugal forces. For the same reason, the blade 8 of the rotating unit 6 is also tapered. Alternatively, the blades 8 can be spirally arranged (shown in phantom) on the circumference of the drive shaft 10 to deliver, and compress, air from the radially inner area to the outer areas of the axial-flow compressor. As in FIG. 10, the tilting rotor 7 can again have a partially spherical portion 25.

Obviously, application of the present invention already to the forward stages of the axial-flow compressor provides for increased pressure build-up. Consequently, fewer compressor stages than on conventional axial-flow compressors are required for the same pressure build-up. Therefore, the axial-flow compressor according to the present invention is shorter and lighter.

LIST OF REFERENCE NUMERALS

1 Rotor
2 Casing
3 Rotor blades
4 Stator vanes
5 Actuating mechanism
6 Rotating unit
7 Tilting rotor
8 Blade
9 Tilting rotor blade
10 Drive shaft
11 Driving device
12 Bearing
13 Platform
14 Pivot
15 Inner shroud
16 Curvilinear portion
17 Rib
18 Stator vane row
19 Blade end
20 Pocket of blade
21 Tilting rotor blade end
22 Inner space
23 Closed space
24 Circumference
25 Spherical portion
26 Drive axis
27 Axial-flow compressor rotary axis
28 Pocket of tilting rotor blades
29 Rotary axis of tilting rotor
30 Gaps between ribs 17
31 Passages

What is claimed is:

1. An axial flow compressor, comprising:

at least one stator vane row having at least one blade, the at least one blade being configured as a rotating unit being completely rotatable about a drive axis of the blade, and with the drive axis of the blade being essentially perpendicular to a rotary axis of the axial-flow compressor;

wherein the at least one blade is connected to a tilting rotor on at least one blade end.

2. The axial flow compressor of claim 1, wherein the rotating unit includes a drive shaft, with the drive axis of the blade being formed by the drive shaft, and with the blade being connected to the drive shaft.

3. The axial flow compressor of claim 1, wherein the tilting rotor includes a tilting rotor blade and wherein an end of the blade includes a pocket, with the tilting rotor blade of the tilting rotor being in engagement with this pocket.

4. The axial flow compressor of claim 1, wherein the tilting rotor includes a tilting rotor blade having a tilting rotor blade end having a pocket, with an end of the at least one blade of the stator vane row being in engagement with this pocket.

5. The axial flow compressor of claim 1, wherein the tilting rotor is inclined to align with a circumferential surface of a main flow path of the compressor.

6. The axial flow compressor of claim 1, and comprising a rib, which extends from a casing to an inner shroud, and is positioned circumferentially adjacent a rotating unit to form a closed space with the blade of the stator vane unit for the compression of gas.

7. The axial flow compressor of claim 6, wherein the rib includes passages for passing liquids.

8. The axial flow compressor of claim 7, wherein a circumference of the rotating unit increases in a radial direction of the axial flow compressor.

9. The axial flow compressor of claim 2, wherein the drive shaft is tapered.

10. The axial flow compressor of claim 2, wherein the blade is spirally wound around the drive shaft.

11. The axial flow compressor of claim 4, wherein the tilting rotor includes a partially spherical portion surrounding a pivot established by an intersection of the drive shaft and a rotary axis of the tilting rotor.

12. The axial flow compressor of claim 2, wherein the rotating unit includes several blades distributed around a circumference of the drive shaft.

* * * * *